US007451503B2

(12) United States Patent
Caillaud

(10) Patent No.: US 7,451,503 B2
(45) Date of Patent: Nov. 18, 2008

(54) BEDDING ASSEMBLY WITH TWO LIFTABLE BEDS

(75) Inventor: Gilbert Caillaud, Les Epesses (FR)

(73) Assignee: Griffon SA, Chambretaud (FR)

( * ) Notice: Subject to any disclaimer, the term of this patent is extended or adjusted under 35 U.S.C. 154(b) by 0 days.

(21) Appl. No.: 11/896,700

(22) Filed: Sep. 5, 2007

(65) Prior Publication Data

US 2008/0060130 A1 Mar. 13, 2008

(51) Int. Cl.
*A47C 17/50* (2006.01)
*A47C 17/38* (2006.01)

(52) U.S. Cl. ..... 5/8; 5/136

(58) Field of Classification Search ..... 5/8, 5/133–157

See application file for complete search history.

(56) References Cited

U.S. PATENT DOCUMENTS 866,954 A 9/1907 Nehr
1,350,327 A 8/1920 Moir
2,569,574 A 10/1951 Parker
2,724,128 A * 11/1955 Schulz ..... 5/135

FOREIGN PATENT DOCUMENTS

| | | |
|---|---|---|
| DE | 858594 | 12/1952 |
| DE | 3419204 | 11/1985 |
| FR | 2144055 | 2/1973 |

* cited by examiner

*Primary Examiner*—Alexander Grosz
(74) *Attorney, Agent, or Firm*—Jacobson Holman PLLC

(57) ABSTRACT

Bedding assembly comprising a piece of furniture in which two beds for one person are rotatably mounted around a horizontal axis, between an active position where the bed/s is/are parallel to the floor and close thereto, and a lifted position, or vertical position, where the bed/s is/are folded up in the piece of furniture, wherein the bedding assembly has means allowing the lateral translation of at least one bed in a direction parallel to the rotation axis of the beds. One of the beds is fixed in translation, while the other one is mobile in translation. The assembly comprises a carriage on which one of the beds is rotatably mounted, and mobile in translation on at least one rail. The carriage moves on two parallel rails, i.e. a rear rail and a front rail, by means of a slide (for each rail) that is integral with the carriage.

7 Claims, 5 Drawing Sheets

BEDDING ASSEMBLY WITH TWO LIFTABLE BEDS

This invention relates to a piece of furniture forming a bedding assembly with two liftable beds, and more particularly two beds for one person, rotatably mounted on the piece of furniture, along a substantially horizontal axis, between an active position where one and/or the other bed is/are parallel to the floor and close thereto, and a lifted position, or vertical position, where the bed/s is/are folded up into the piece of furniture.

There are several types of structures arranged in pieces of furniture forming a bedding assembly, making it possible to offer bedding for only one person or for two persons, and offering significant space saving when the bed (for two) or the two beds for one person is/are lifted into the piece of furniture.

For example, DE 3419204 describes a structure for putting away two beds in a piece of furniture. That structure has two pivoting connections around which the beds move from the horizontal position to the vertical position. Thereafter, the structure is moved translationally by means of castors and fits partly into a recess in the piece of furniture.

FR 2144055 discloses the conventional structure of a furniture bed, enabling the base of the bed to pivot by 90 degrees around a joint, in order to unfold the bed elements. When unfolded in the horizontal position, the bed can then turn around the pivot.

As regards these beds described in the prior art, users require ever more convenience and versatility. In particular, they would appreciate to be able to modulate the use of the bedding assembly according to their needs and have several possibilities within the same assembly, such as for instance two persons together, one person alone or two persons separate from each other.

Such a need is particularly felt in the hotel industry and holiday or recreational accommodation.

Bedding assemblies and their associated structures of the known type do not offer such modularity.

This invention overcomes that drawback and provides a bedding assembly that is integrated into a piece of furniture and can be used as required, particularly for two persons together, one person alone or two persons separately.

To that end, according to the invention, the bedding assembly of the type comprising a piece of furniture in which two beds for one person are rotatably mounted along a substantially horizontal axis, between an active position where the bed/s is/are parallel to the floor and close thereto and a lifted position, or vertical position, where the bed/s is/are folded up into the piece of furniture, is characterized in that it comprises means enabling the lateral translation of at least one bed, in a direction parallel to the rotation axis of the beds.

Preferably, one of the two beds is fixed in translation and the other is mobile in translation.

Thereby, the bedding assembly of that type comprises a first bed rotatably mounted around a pivot accommodated in two brackets located each on a support plate, wherein a second bed moved translationally a along a direction parallel to the X-X axis by means of a carriage, on which said second bed is rotatably mounted.

In the present circumstances, the carriage has two support plates which are provided with brackets adapted to accommodate a pivot around which the second bed is rotatably mounted, and two spacers.

According to an advantageous embodiment, the assembly comprises a carriage on which one of the beds is rotatably mounted, and which is mobile in translation on at least one rail.

Preferably, the said carriage is adapted to be movable on at least two parallel rails, i.e. a rear rail and a front rail, by means of at least one slide (for each rail) that is integral with the carriage.

Two slides are provided for the front rail and one slide for the rear rail.

According to a preferred embodiment, the rails have a circular cross-section and each slide is made up of a block with a hole or conduit having a shape complementary to the said rail.

The travel in translation of the mobile bed ranges from 20 cm to 80 cm, preferably from 30 cm to 45 cm.

The invention will be easily understood in the light of the description below, by reference to illustrative but not limitative examples, on the basis of the drawings attached, where:

In the description below, the terms "upper" and "lower" refer to their position in respect of the floor of the room, particularly a bedroom, in which the piece of furniture according to the invention is likely to be placed. Similarly, the terms "front" and "rear" refer to the position occupied in the piece of furniture, away from the back of the piece of furniture that is to be set against the wall of the room and near the said wall, respectively.

Figure 1:
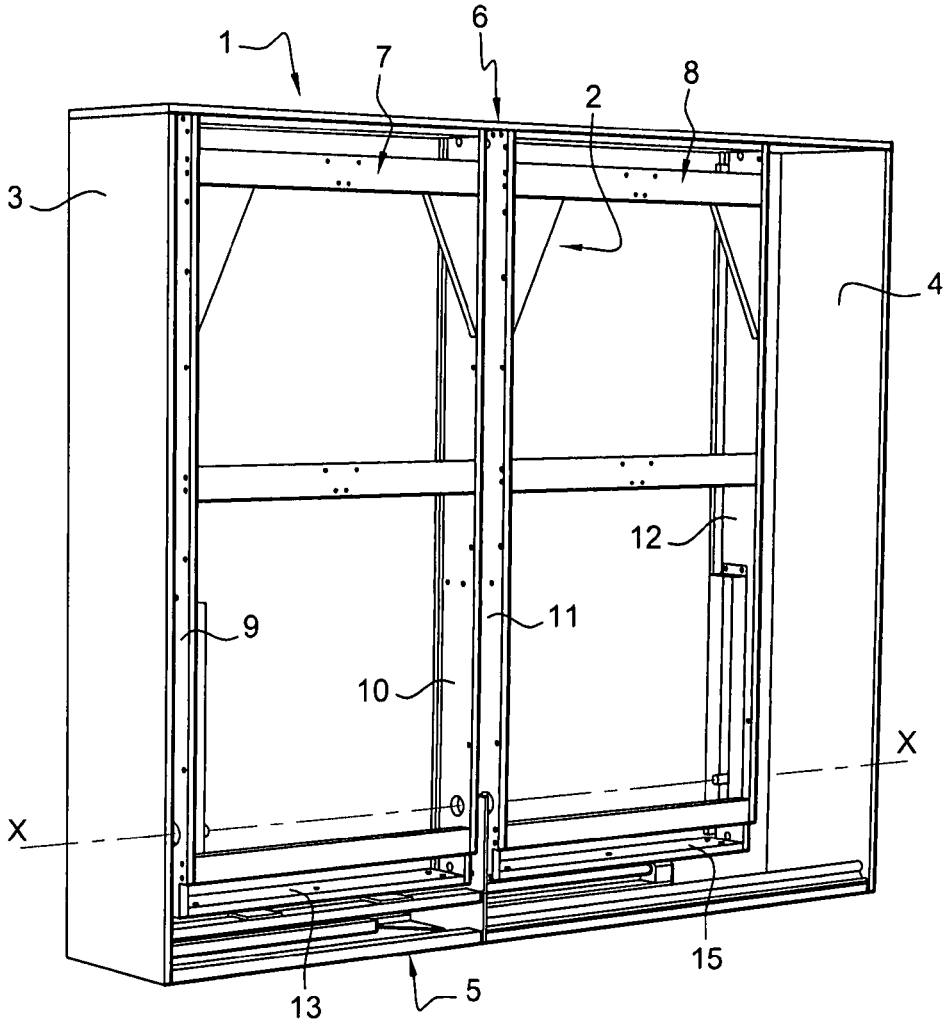
FIG. 1 is a front perspective view of the piece of furniture according to the invention provided with two beds for one person each, where each bed is in the vertical lifted position.

Reference is made to FIG. 1, showing a front perspective of a piece of furniture according to the invention, forming a bedding assembly. The piece of furniture 1 according to the invention has the general shape of a parallelepipedic box comprising a rear vertical board 2, two vertical side walls 3 and 4, a horizontal base 5 and an upper horizontal covering board 6.

The rear board 2 is designed to be set against the wall of the room, such as a bedroom in which the piece of furniture is placed. The piece of furniture has a side open towards the user, i.e. turned towards the said room.

Within the volume delimited by the box forming the piece of furniture, two mattress bases are placed, each for one person, referenced 7 and 8 respectively. These bases are mounted articulated on the piece of furniture to enable a rotational movement of each bed independently of each other. Such rotational movement takes place along a horizontal X-X axis close to the base 5 of the piece of furniture, more specifically between about 10 cm and 30 cm from the floor, preferably at about 20 cm from the floor.

Figure 2:
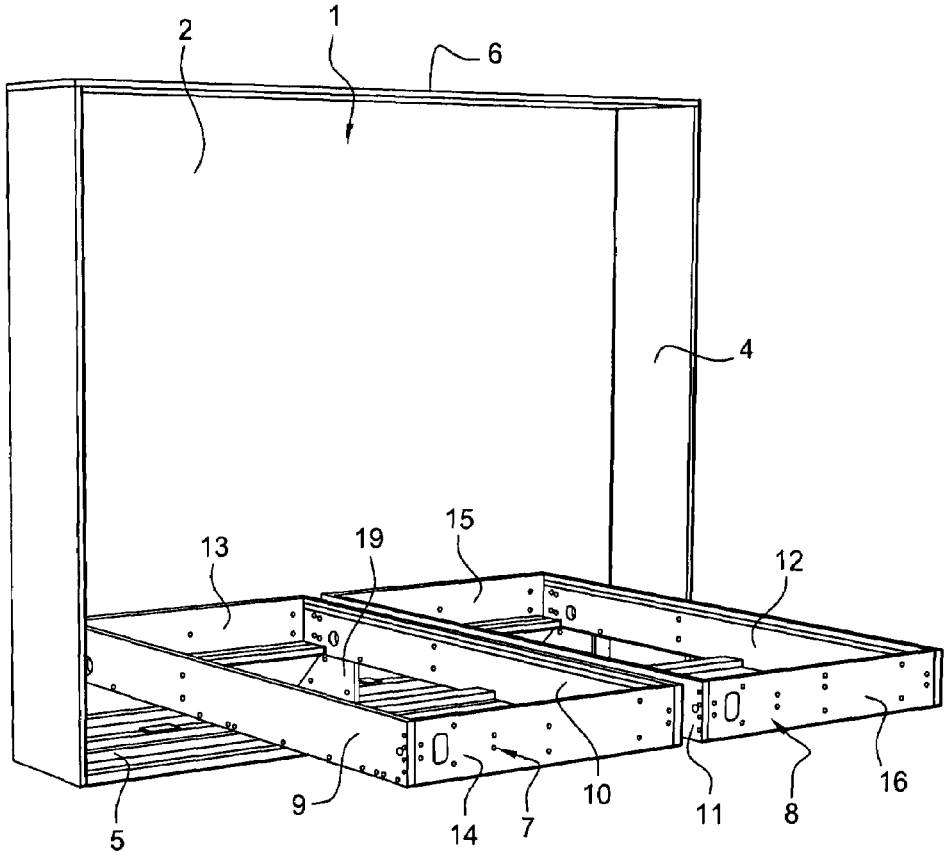
FIG. 2 is a front perspective view of the assembly of FIG. 1, showing the two beds in the horizontal active position.

The rotational movement of each bed is about 90°, between two extreme positions, namely:

- one position shown on FIG. 1, where the two beds 7 and 8 are in the vertical position, lifted and inactive; they are then fully integrated into the volume formed by the piece of furniture 1;
- one position shown on FIG. 2, where the two beds 7 and 8 are in the active position, horizontal and unfolded.

Each bed 7 or 8 comprises a frame made up of:

two parallel longitudinal members, 9 and 10, and 11 and 12 respectively;

two parallel cross members, 13 and 14, and 15 and 16 respectively.

The means for rotational mounting on the piece of furniture are described below, referring mainly to FIG. 3 and also to FIGS. 1 and 2.

The means for the rotational mounting of the first bed, referenced 7 and located to the left on FIGS. 1 and 2, are described first:

a first support plate 17 (not visible on FIG. 1) fixed to the inside face (turned towards the inside of the piece of furniture 1) of the side wall 3 and provided with a bracket 18 with a general U shape and which defines a housing adapted to accommodate a rotating pivot (not shown) mounted on the longitudinal member 10;

a second support plate 19, parallel to the first one, resting either on the horizontal base 5 of the piece of furniture or on the floor of the room, and comprising a U-shaped support 20.

Preferably, each support plate 17 and 19 is shaped as a rectangular trapezoid, the large base of which is close to the floor, and near the small base is fixed the corresponding pivot support 18 and 20 respectively.

Figure 3:
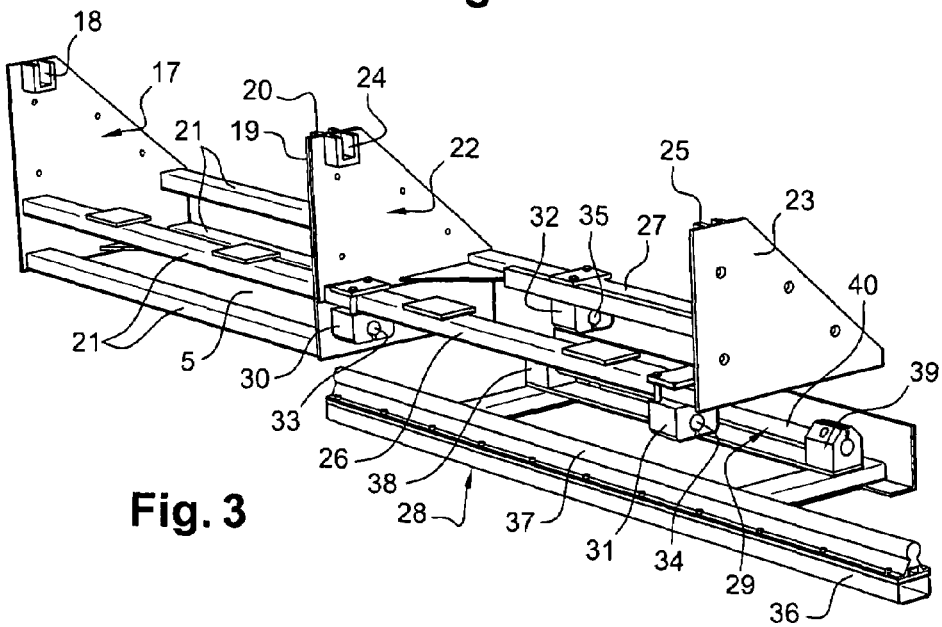
FIG. 3 is a detailed front perspective view of the support means of the beds and of the translation means of the mobile bed.

As shown on FIG. 3 in particular, the two support plates 17 and 19 are associated in a known manner with several spacers parallel to the floor and to each other, bearing the common reference 21.

The support plate 17 is fixed to the side wall 3 of the piece of furniture 1 by all appropriate means, such as screws or the like.

The second bed 8, located to the right on FIGS. 1 and 2, comprises a rotational assembly similar to that of bed 7, and also translation means for the bed 8 described later.

The elements that comprise the rotational assembly of the first bed 7 on the left are also shown on FIG. 3. The rotational assembly of the second bed 8 comprises two support plates 22 and 23 parallel to each other, vertical, and preferably with a rectangular trapezoid shape. These plates are identical to plates 17 and 19 for the first bed 7. Near the small base of each plate 22, 23, there is provided a bracket 24 and 25 respectively, each adapted to accommodate a pivot (not shown) defining the X-X rotation axis of the bed.

Near the large base of each trapezoid formed by a support plate 22 and 23 are fixed a front spacer 26 and rear spacer 27 parallel to each other and horizontal.

According to one of the particularities of the invention, the carriage formed by the two spacers 26 and 27 and the two support plates 22 and 23 is mobile in translation, parallel to the X-X rotation axis of the beds.

The means enabling the translation of bed 8 are described below in detail, particularly by reference to FIG. 3.

More specifically, the carriage (22, 23, 26, 27) is slidably mounted on two parallel rails, respectively a front rail 28 and a rear rail 29, by means of two front slides 30 and 31 and one rear slide 32, respectively. Each slide is formed by a parallel-epipedic block comprising a through hole or orifice 33, 34 and 35 respectively.

The front rail 28 comprises:

a rectilinear base 36, preferably formed of a hollow metal member with a rectangular section, resting on the floor or on the base 5 of the piece of furniture;

a slide member 37, resting on the said base 36, and having a circular section in the example shown.

For reasons of clarity, the slides are not represented engaged with the rails on FIG. 3.

The two front slides 30 and 31 are placed at the ends of the distance separating the two support plates 22 and 23.

The rear rail 29 includes a base made up of two blocks 38 and 39 between which a slide member 40 with a preferably circular cross-section is fixed; the slide 32 is adapted to slide on the slide member 40.

In the starting position where the second bed 8 is close to the first bed 7 (FIG. 1), the rear slide block 32 is placed substantially at a third of the distance separating the two support plates 22 and 23, near the plate 22, i.e. near the bed 7.

It can be understood from FIG. 3, (even though the slides are not shown engaged in the respective rails), that the carriage formed by the support plates 22 and 23, the spacers 26 and 27, and the slide blocks 30, 31 and 32 can move laterally, i.e. in a direction parallel to the X-X rotation axis of the beds.

The travel of the rear slide 32 is stopped by the support block 39 of the rear rail 40.

The slides 30, 31 and 32 form a triangular base for the said sliding carriage (including the support plates 22 and 23).

Reference is now made to FIG. 1 showing the two beds in the vertical lifted position, close to each other.

From that position, the user first translates the second bed 8, which is still in the vertical position, away from the fixed bed 7 and towards the other side wall 4, until it is almost in contact with that wall. That results in the representation of FIG. 4, where the first bed 7 and the corresponding part of the piece of furniture are not shown for reasons of clarity.

Figure 4:
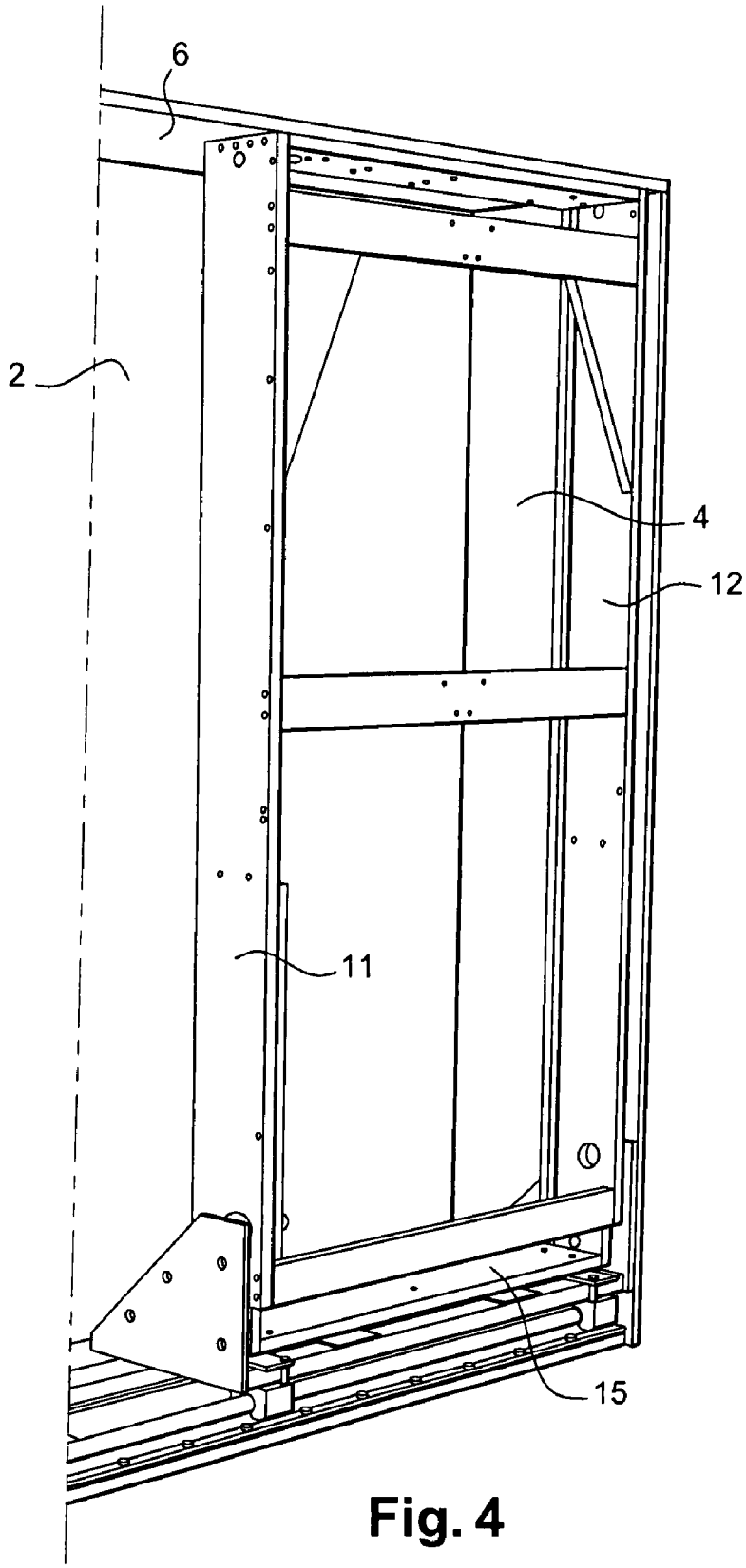
FIG. 4 is a front perspective view of part of the piece of furniture, showing the mobile bed in the vertical lifted and translated position.
Figure 5:
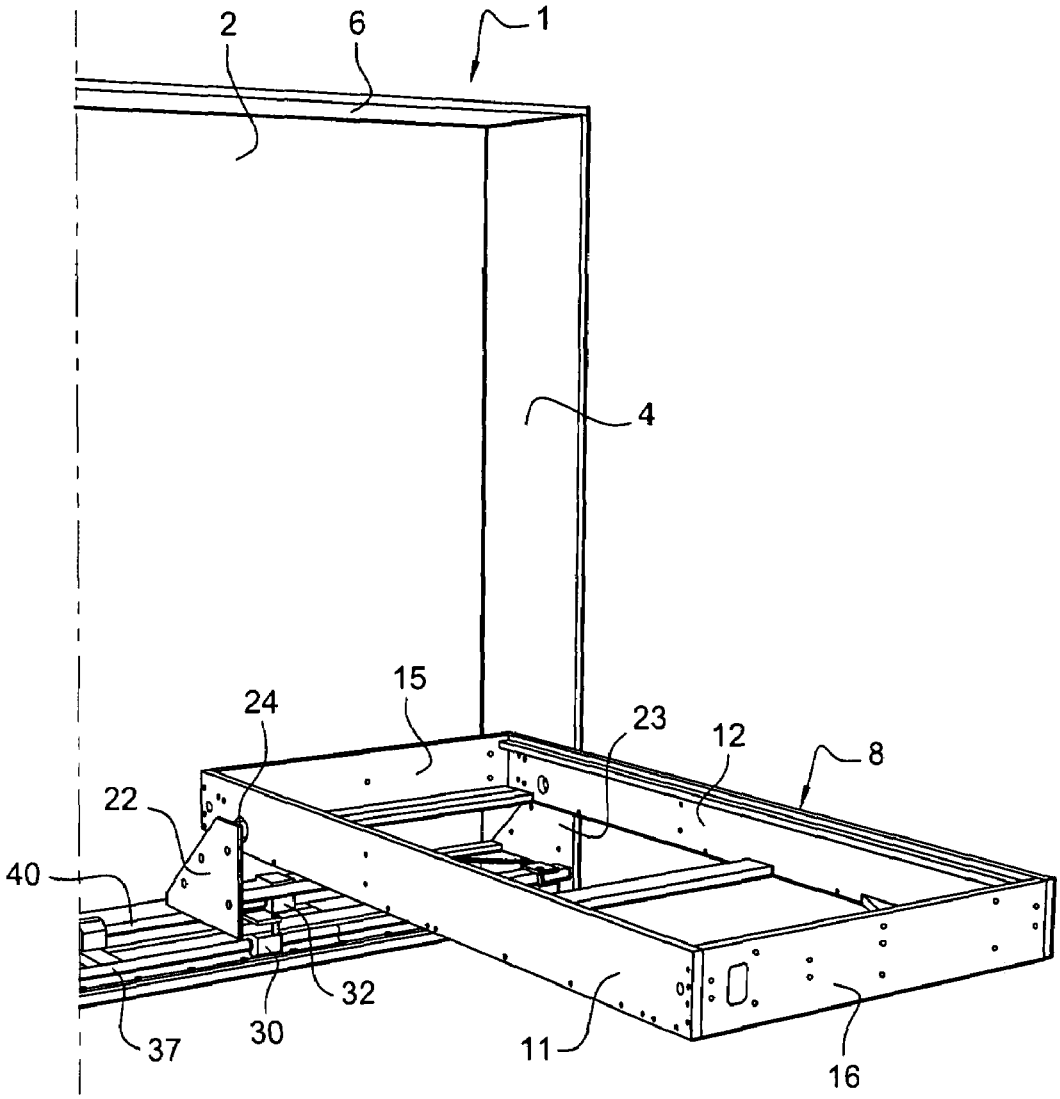
FIG. 5 is a view similar to that of FIG. 4, where the mobile bed is in the horizontal active position.

Thereafter, the user tilts the second bed 8 around the horizontal X-X axis to bring it into its active horizontal position, as shown on FIG. 5, where, as on FIG. 4, only the second bed 8 is shown. It is understood that, during the maneuver of the second bed 8, the first bed 7 may be in the vertical lifted position or in the active horizontal position.

In a known manner, the piece of furniture has, firstly, means to absorb the tilting motion of each bed from the vertical lifted position to the horizontal active position and, secondly, means for retaining or stopping the bed on the piece of furniture, in the horizontal active position, or means to support the bed (such as folding feet) in its horizontal active position, on the floor. For reasons of clarity, these means, which are known in the State of Art, are not represented on the figures.

Figure 6:
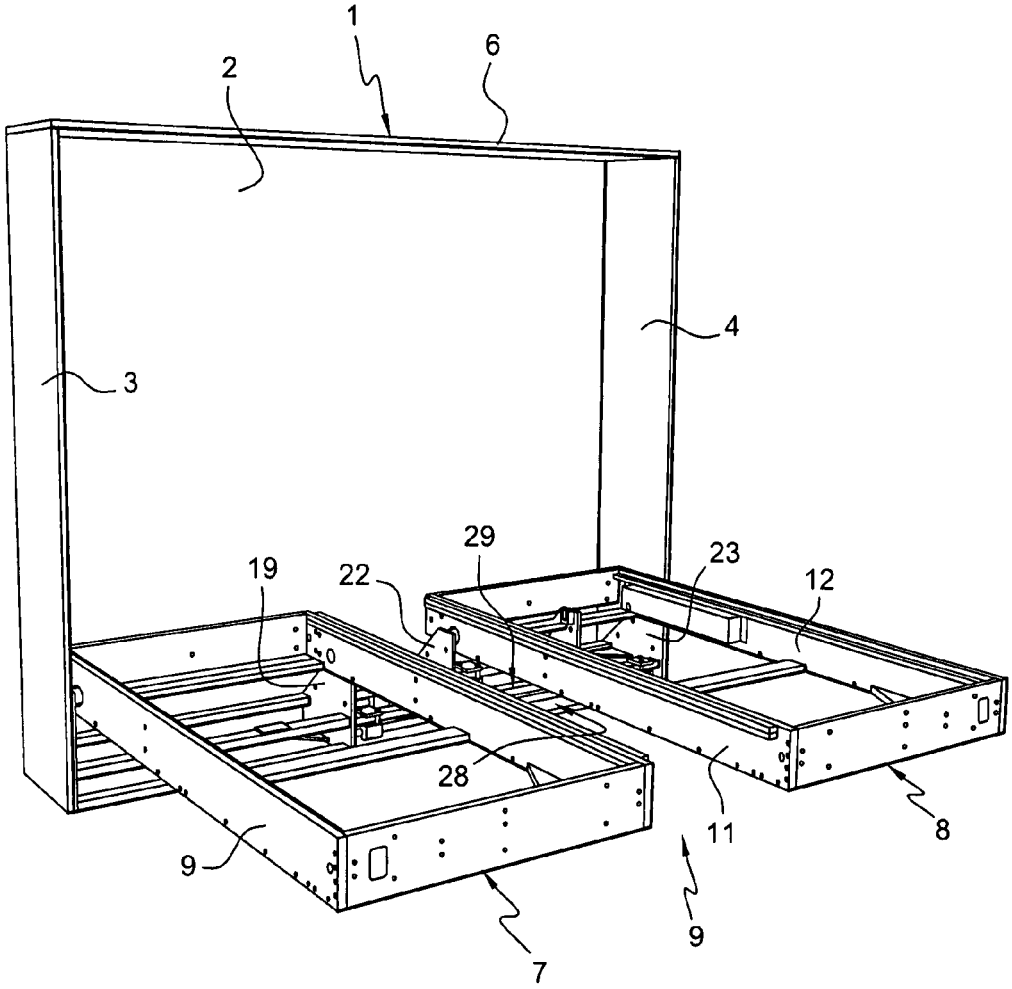
FIG. 6 shows the two beds in the horizontal active position, the mobile bed being translated.

Thereafter, the user tilts the first bed 7 to its active horizontal position, which results in the position shown on FIG. 6, offering bedding for two persons, separate from each other.

The bedding assembly according to the invention makes it possible to place the two beds 7 and 8 in the active horizontal position at a variable distance, near or in contact with each other.

Also, the user may tilt only one bed to the horizontal position, the other remaining in the vertical position.

Thereby, the carriage of the invention allows the translation and rotation of the bed 8 around the X-X axis. It makes it possible to uncouple the independent rotation movements, around axis X-X, of the two beds 7 and 8 from the translation movement of the bed 8 along a direction substantially parallel to axis X-X. In other words, the bed 8 is moved translationally along axis X-X without moving the bed 7, and the beds 7 and 8 pivot around axis X-X independently of each other.

The invention claimed is:

1. Bedding assembly comprising a piece of furniture in which two beds are mobile in rotation along a substantially horizontal axis X-X, between an active position where the beds are parallel to the floor and close thereto, and a lifted position where the beds are folded away into the piece of furniture, in the vertical position, one of the two beds being fixed in translation along the X-X axis, the second bed being mobile in translation along the X-X axis, the second bed being mounted on a carriage mobile in translation along a direction parallel to axis X-X, on which it pivots.

2. Assembly according to claim 1, wherein the said carriage includes two support plates on which are provided brackets adapted to accommodate the pivot around which the bed pivots, and two spacers.

3. Assembly according to claim 2, wherein the said carriage is adapted to move on at least two parallel rails, namely a rear rail and a front rail, by means of at least one slide for each rail integral with the spacers of the carriage.

4. Assembly according to claim 3, wherein two slides are provided for the front rail, and one slide for the rear rail.

5. Assembly according to claim 4, wherein the rails have a circular cross-section.

6. Assembly according to claim 5, wherein each slide is made up of a parallelepipedic block comprising a hole or conduit with a shape complementary to the circular cross-section of each associated rail.

7. Assembly according to claim 6, wherein the travel in translation of the mobile bed ranges from 20 cm to 80 cm.

* * * * *